US006481354B1

(12) United States Patent
Heck et al.

(10) Patent No.: US 6,481,354 B1
(45) Date of Patent: Nov. 19, 2002

(54) MORTAR FUSE WITH A ROTATABLE FAN

(75) Inventors: Rainer Heck, Schramberg (DE); Reiner Hennig, Mönchweller (DE); Frank Kienzler, Villingen (DE); Detlef Pabst, Dunningen (DE); Jürgen Voigt, Schramberg (DE); Wolfgang Zehnder, Schramberg (DE)

(73) Assignee: Junghan Feinwektechnik GmbH & Co. KG, Schramberg (DE)

( * ) Notice: Subject to any disclaimer, the term of this patent is extended or adjusted under 35 U.S.C. 154(b) by 0 days.

(21) Appl. No.: 09/856,619

(22) PCT Filed: Nov. 26, 1999

(86) PCT No.: PCT/EP99/09195

§ 371 (c)(1),
(2), (4) Date: May 24, 2001

(87) PCT Pub. No.: WO00/31497

PCT Pub. Date: Jun. 2, 2000

(30) Foreign Application Priority Data

Nov. 26, 1998 (DE) ..... 198 54 607

(51) Int. Cl.[7] ..... F42C 15/18
(52) U.S. Cl. ..... 102/225; 102/427
(58) Field of Search ..... 102/225, 427

(56) References Cited

U.S. PATENT DOCUMENTS 2,403,567 A 7/1946 Wales, Jr.
2,511,872 A * 6/1950 Parker ..... 102/208
2,755,737 A * 7/1956 Clarke ..... 102/208
2,775,941 A * 1/1957 Plumley ..... 102/209
2,900,911 A * 8/1959 Statham ..... 102/212
2,965,035 A * 12/1960 Wynn ..... 102/209
2,989,921 A * 6/1961 Leonard et al. ..... 102/263
3,680,482 A * 8/1972 Hall ..... 102/209
3,757,695 A * 9/1973 Fisher ..... 102/207

FOREIGN PATENT DOCUMENTS

EP 0 349 375 1/1990
GB 08 507 11/1913

* cited by examiner

*Primary Examiner*—Charles T. Jordan
*Assistant Examiner*—M Thomson
(74) *Attorney, Agent, or Firm*—Burns, Doane, Swecker & Mathis, LLP

(57) ABSTRACT

A mortar fuse includes a fan wheel rotated in response to motion of the mortar fuse after the mortar has been launched. The fan wheel rotates a helix on which an activation wheel is mounted. The activation wheel moves in a path along the axis of the helix in response to rotation of the helix and eventually impacts against, and pierces, an acid container. Battery acid flows from the container and into battery cells, to energize the battery. The activation wheel includes a magnetic material. A coil is disposed along the path of travel of the activation wheel so that electric energy is generated in the coil as the magnetic activation wheel moves therepast. The electric energy operates a counter which controls a time function of the mortar fuse.

6 Claims, 2 Drawing Sheets

MORTAR FUSE WITH A ROTATABLE FAN

BACKGROUND OF THE INVENTION

The invention relates to a mortar fuse comprising a fan wheel, a generator for the firing energy, a safety device, a fuse device and a double pin as a release device for the fan wheel and the safety device.

The usual mortar fuses have a fan wheel generator which, by means of the fan wheel which rotates in the flow of air, serves to generate the energy for the fuse and to drive the safety device. Fan wheel generators of that kind suffer from the disadvantage that the energy generated is dependent on the speed of rotation of the fan wheel generator, which can fall to zero at the apogee of the trajectory of the mortar shell. That can result in an energy failure or at least adverse effects in terms of reliability of the fuse. A further problem is that the fan wheel can ice up during the flight and come to a stop, also with the problem of energy failure.

The object of the present invention is to propose a highly reliable mortar fuse in which the energy supply of the fuse does not depend on continuous rotation of the fan wheel.

SUMMARY OF THE INVENTION

To attain that object, the invention proposes that there is provided an activatable battery which can be brought into operation by an activation wheel driven along a path of travel by the fan wheel. The activation wheel includes a magnetic material, and a coil is disposed adjacent the path of travel. Electric energy is generated in the coil as the magnetic activation wheel passes thereby.

The invention is therefore based on the point that the use of a per se known activatable battery during flight provides for activation of an activation wheel driven by the fan wheel, with a predetermined time delay between launch of the projectile and attainment of the actuation position. Depending on the respective type of battery used, activation again requires a certain period of time before the battery is fully operational. It is at the latest from that moment in time that the speed of rotation of the fan wheel is no longer an important consideration in terms of operability of the fuse.

In accordance with a development of the invention, to produce the time of activation of the battery, it is provided that the activation wheel can be displaced along a spiral on the shaft of the rotating fan wheel and can be brought into contact with the activatable battery.

In a development of the invention, it has been found particularly desirable that the activatable battery comprises a battery container with the battery cells and an acid container which is directly adjacent but separate therefrom, which acid container can be pierced by the activation wheel whereby acid flows into the battery container.

In accordance with a further configuration of the invention, to increase the fail-safe nature of the fuse, it is provided that the activation wheel has a magnet which, upon rotation thereof, moves past a coil and generates energy.

That energy serves during the activation phase of the battery to supply power to the fuse and in particular serves for the supply of energy for a counter which controls the time function of the fuse.

Finally, a further configuration of the invention provides that there is an emergency power supply which includes one or more capacitors and which cooperates with the activation wheel and which ensures operation of the counter in the event of a possible power failure in respect of the battery.

The emergency power supply can also be used when using a fan wheel generator.

BRIEF DESCRIPTION OF THE DRAWINGS

The invention will be described in greater detail hereinafter by means of two embodiments. In the drawing.

DETAILED DESCRIPTION 0F PREFERRED EMBODIMENTS OF THE INVENTION

Figure 1:
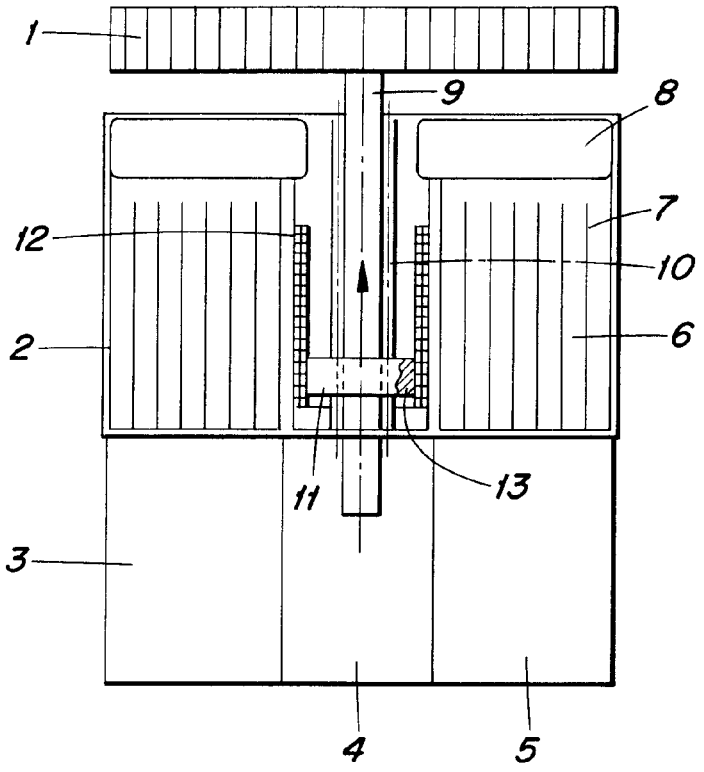
FIG. 1 shows a first embodiment of the invention.

FIG. 1 is a highly diagrammatic view of the component units of a mortar fuse, which are essential in connection with the invention. Reference 1 denotes a fan wheel, reference 2 a battery, reference 3 a safety device, reference 4 the electronic system and reference 5 the fuse.

The battery 2 comprises a battery container 6 and battery cells 7. No acid is contained in the battery container in the rest condition of the fuse, that is to say in the condition of not having been launched. The battery is therefore not yet operational. Disposed above the battery container is an acid container 8 which, in the activation situation, after launch, is destroyed so that the acid can be emptied into the battery container disposed therebeneath. The battery container and the acid container are each of an annular configuration and form a cylindrical space through which the shaft 9 of the fan wheel passes. Provided on the shaft 9 is a spiral 10, i.e., helix, on which in turn a gear 11 can longitudinally slidably move. When the fan wheel 1 rotates the gear 11 moves upwardly along the spiral 10 and destroys the acid container 8.

Disposed in the cylindrical space of the battery container, at the wall surfaces thereof, is an electric coil 12 which cooperates with a magnetic coating 13 on the gear 11 and in which, upon rotation of the gear, energy is generated for the power supply for the fuse and an emergency power supply if required.

The mode of operation of this arrangement is as follows. Upon launch of the projectile carrying the mortar fuse, the fan wheel which is disposed in the head of the fuse at the tip of the projectile begins to rotate. At the same time the gear 11 rotates and with its magnet 13 generates in the coil 12 energy which activates the electronic firing system 4 of the fuse and in particular the time counter thereof. The gear 11 moves upwardly along the spiral 10 and finally reaches the inwardly projecting edge of the acid container 8. Due to the pressure of such impingement the acid container is destroyed and the content thereof pours into the battery container 6. After a short time the battery is ready for operation and from then on takes over the power supply for the electronic fuse system 4. The gear 11 has left the region of the coil 12 and is no longer producing any energy. For the further power supply for the electronic fuse system, it is now immaterial whether the speed of rotation of the fan wheel decreases by virtue of the decreasing speed of the projectile and the fact that the projectile has passed beyond the apogee of its trajectory. The drive for the safety device by the fan wheel is not the subject-matter of the invention and is not described herein. The same applies for the arming of the fuse by the electronic fuse system.

Figure 2:
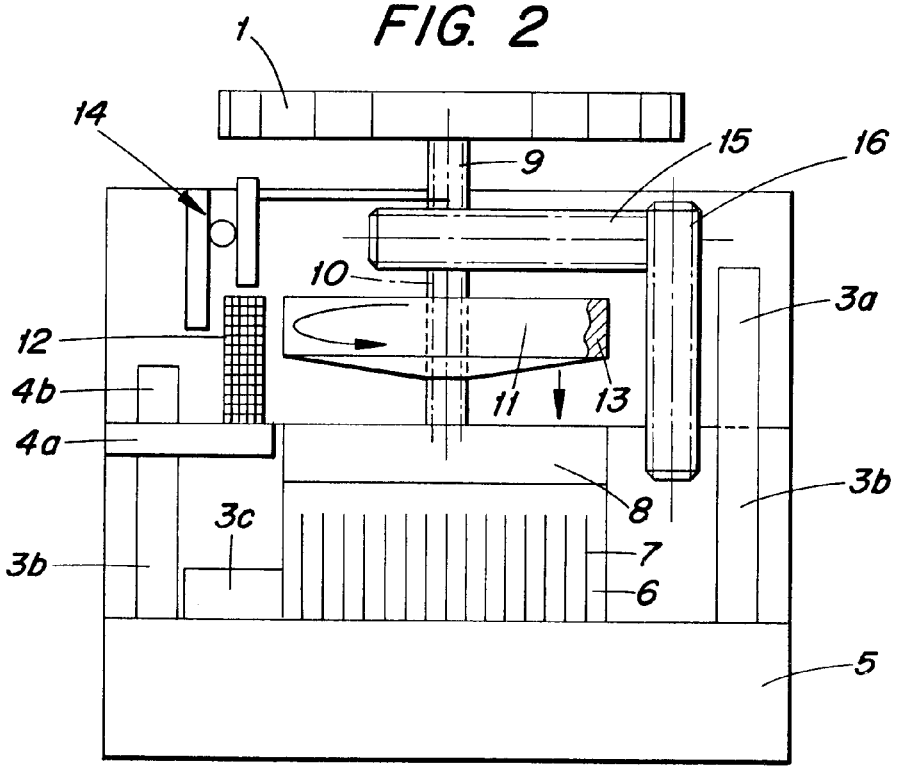
FIG. 2 shows a second embodiment of the invention.

In FIG. 2, the same components as in the embodiment of FIG. 1 are denoted by the same references. Reference 14 denotes a double pin which represents the primary safety system of the fuse, which is released upon launch and which thereby releases the fan wheel 1. That double pin arrangement is a component which is conventional practice in fuses and is not described in greater detail herein.

A worm gear 15 and a safety pin 16 serve for mechanically releasing the safety device 3. The worm gear meshes on the shaft 9 and cooperates with a spiral on a safety pin 16. When the shaft 9 rotates, the safety pin 16 is unscrewed from the safety device 3 by the worm gear 15, and the-safety device 3 which has a mechanical detonator 3*a* and a firing transmitter 3*b* is released into the armed position. A spring 3 serves for mechanical displacement of the safety device into the armed position.

The electronic firing system 4 comprises a firing circuit 4*a* and an electrical detonator 4*b* and is supplied with power by the battery or the coil 12. The mode of operation of this arrangement is very similar to that of the arrangement shown in FIG. 1. After launch of the projectile the double pin 14 in the head of the fuse is actuated and releases the fan wheel 1 for rotation. By way of the shaft 9 of the fan wheel 1, the gear 11 with the magnet 13 is rotated and generates current pulses in the coil 12. At the same time the gear 11 moves longitudinally slidably downwardly by way of the spiral 10, impinges against the acid container 8 and destroys same. The content thereof pours into the battery container 6 and activates the battery. The battery now takes over the power supply for the firing circuit 4*a* and the electrical detonator 4*b*.

At the same time the worm gear 15 is rotated by the axis 9 and in turn rotates the safety pin 16 out of its rest position, whereby the safety device 3 is released and urged into its armed position by the spring 3*c*. The fuse is now fully armed.

Figure 3:
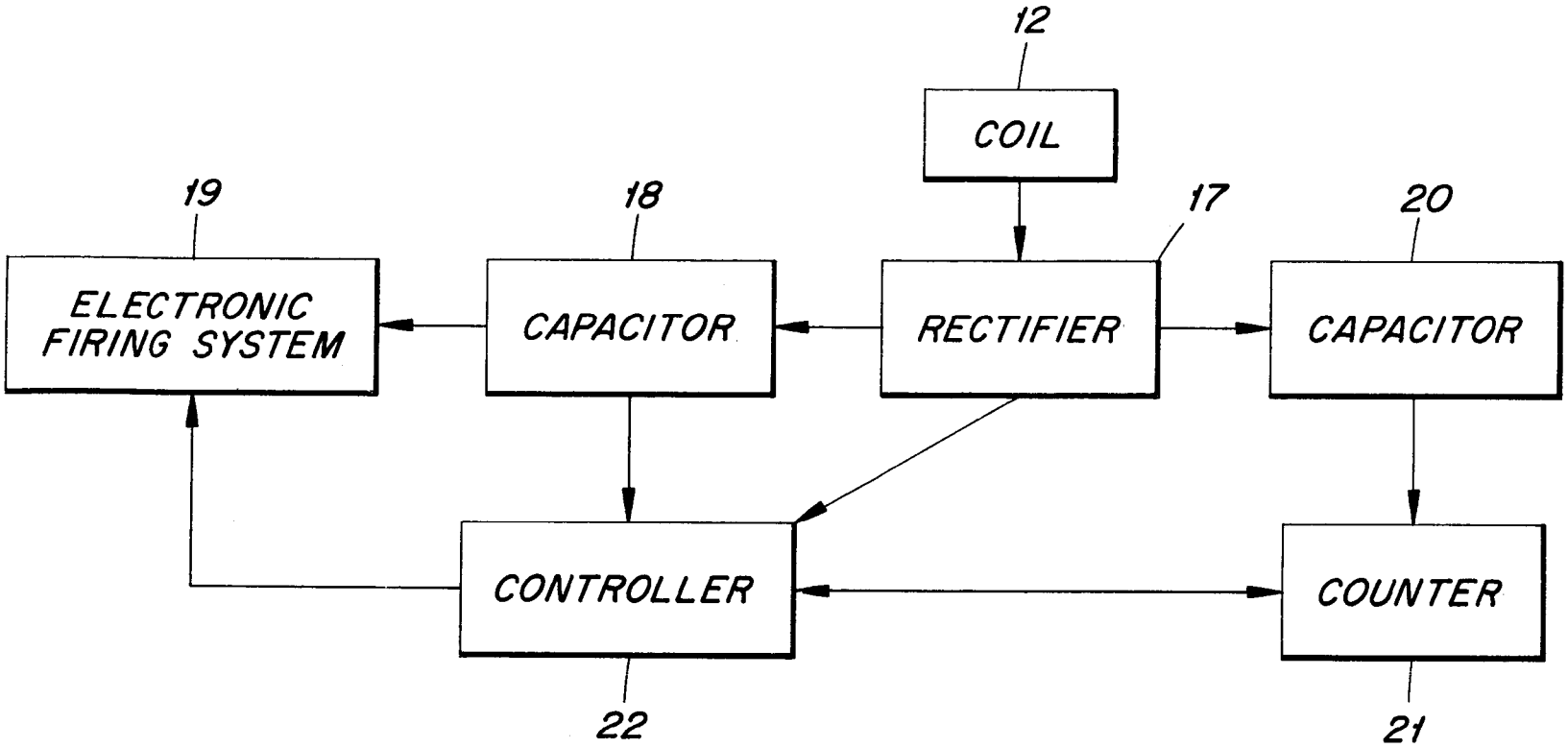
FIG. 3 shows a block circuit diagram of an emergency power supply.

If the reliability of the mortar fuse is to be still further improved, it is possible to provide an emergency power supply as shown in FIG. 3, as a precaution against the situation where the activatable battery or a fan wheel generator used fails. That emergency power supply is charged up by the current pulses generated in the coil 12 by the magnet 13 and stores the energy content thereof for the duration of the flight of the projectile. Arranged downstream of the coil 12 is a rectifier 17 to which are connected a first supply capacitor 18 for the energy supply for the downstream-connected electronic firing system 19 and a second supply capacitor 20 with a downstream-arranged time counter 21. A controller 22 serves to control the electronic firing system 19 and the time counter 21. If the speed of rotation of the fan wheel 1 and thus the output voltage of the coil 12 fall below a predetermined threshold value the controller 22 is switched off by way of the rectifier 17 and switches off the electronic firing system 19 and also itself. The counter 21 which is in the form of a so-called low-power counter manages with an extremely low level of power consumption and is fed from the charged-up supply capacitor 20. It is only when that time counter has reached a predetermined count condition that it causes the controller 22 to be switched on again, which is now fed by way of the supply capacitor 18, and likewise the electronic firing system 19. The controller 22 is switched on again in that way only shortly before target impact; the energy stored in the supply capacitor 18 is sufficient for operation of the necessary component units for the fuse to operate properly at the target.

What is claimed is:

1. A mortar fuse comprising:

a fan wheel adapted to be rotated in response to motion of the mortar fuse, the fan wheel being connected to a helix for rotating the helix about a center axis of the helix;

an activation wheel mounted on the helix to be moved in a path of travel along an axis of the helix from a first position to a second position in response to rotation of the fan wheel; the activation wheel including magnetic material;

a deactive battery arranged to be activated in response to the activation wheel attaining its second position; and a coil arranged adjacent to the path of travel of the activation wheel, wherein electric energy is generated in the coil in response to movement of the activation wheel therepast as the activation wheel moves along its path of travel.

2. The mortar fuse according to claim 1 wherein the battery comprises a battery container having battery cells, and an acid container arranged to be pierced in response to the activation wheel attaining the second position, to enable acid to flow from the acid container to the battery cells.

3. The mortar fuse according to claim 1 further including a safety device held in a locked state by a safety pin prior to launching, the safety pin operably connected to the fan wheel to be rotated thereby, and displaced out of locking relationship with the safety device in response to being displaced.

4. The mortar fuse according to claim 1 further including a counter for controlling a time function of the fuse, the time counter being operably connected to the coil to be actuated by the electrical energy generated in the coil by movement of the activation wheel.

5. The mortar fuse according to claim 4 further including an emergency power supply, including at least one capacitor, for actuating the time counter in the event of a failure of the battery or the fan wheel.

6. A mortar fuse comprising:

a fan wheel adapted to be rotated in response to motion of the mortar fuse, the fan wheel being connected to a helix for rotating the helix about a center axis of the helix;

an activation wheel mounted on the helix to be moved in a path of travel along the center axis thereof from a first position to a second position response to rotation of the fan wheel, the activation wheel including magnetic material;

a deactive battery including battery cells and an acid container arranged to transfer acid into the battery cells to activate the battery in response to the acid container being pierced, the acid container being positioned to be pierced in response to the activation wheel attaining the second position;

a coil arranged adjacent to the path of travel of the activation wheel, wherein electrical energy is generated in the coil in response to movement of the activation wheel therepast as the activation wheel moves along its path of travel; and a counter for controlling a time function of the fuse, the counter being operably connected to the coil to be activated by the electrical energy generated in the coil by movement of the activation wheel.

* * * * *